US008888393B1

(12) United States Patent
Hajianpour et al.

(10) Patent No.: US 8,888,393 B1
(45) Date of Patent: Nov. 18, 2014

(54) APPLICATION DEVICES FOR COSMETICS

(76) Inventors: Zoya Hajianpour, Fort Lauderdale, FL (US); Babak Sheikh, Weston, FL (US)

( * ) Notice: Subject to any disclaimer, the term of this patent is extended or adjusted under 35 U.S.C. 154(b) by 0 days.

(21) Appl. No.: 13/473,085

(22) Filed: May 16, 2012

(51) Int. Cl.
*A46B 17/02* (2006.01)
*A45D 34/04* (2006.01)

(52) U.S. Cl.
CPC ..... *A46B 17/02* (2013.01); *A45D 34/045* (2013.01)
USPC ..... 401/131; 401/48; 401/129; 248/131; 248/436; 248/439

(58) Field of Classification Search
CPC ..... A45D 2024/005
USPC ..... 401/48, 131; 248/131, 136, 172, 173, 248/346.07, 436, 439
See application file for complete search history.

(56) References Cited

U.S. PATENT DOCUMENTS 2,140,231 A * 12/1938 Jefferis ..... 215/12.1
4,313,686 A * 2/1982 Proffer ..... 401/127
4,854,760 A 8/1989 Pike et al.
4,961,664 A * 10/1990 Simper ..... 401/127
5,772,163 A * 6/1998 Young ..... 248/139
6,283,660 B1 9/2001 Furlong et al.
7,524,122 B2 4/2009 Pink
7,637,679 B2 12/2009 May et al.
8,313,261 B1 * 11/2012 Mah ..... 401/48
2007/0077112 A1 * 4/2007 Santamaria ..... 401/17
2009/0324318 A1 12/2009 Wilde et al.
2011/0176854 A1 7/2011 Nobles
2012/0042891 A1 2/2012 Rose

FOREIGN PATENT DOCUMENTS

EP 1106161 A2 * 6/2001

* cited by examiner

*Primary Examiner* — David Walczak
*Assistant Examiner* — Joshua Wiljanen
(74) *Attorney, Agent, or Firm* — Ronald V. Davidge

(57) ABSTRACT

An applicator, for a cosmetic liquid, such as nail polish, includes a reservoir and a removable cap sealing an opening in the reservoir. The applicator may be quite small, holding nail polish for a single application to a person's nails, having a number of legs that can opened so that the applicator can rest on a table. Alternately, the applicator may be built to be handled like a pen, with a piston that is driven to supply the liquid. Features are provided for the attachment of two or more such applicators to one another.

6 Claims, 6 Drawing Sheets

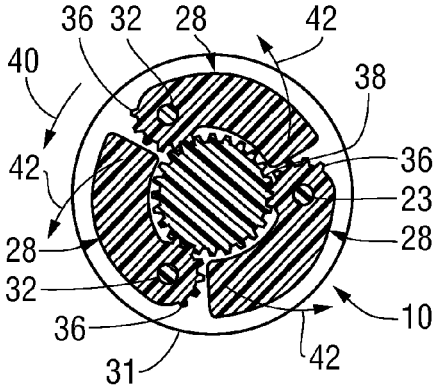
FIG. 5
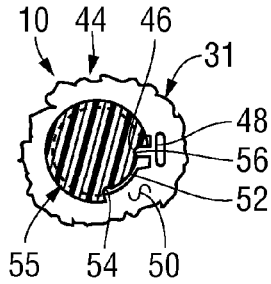
FIG. 6
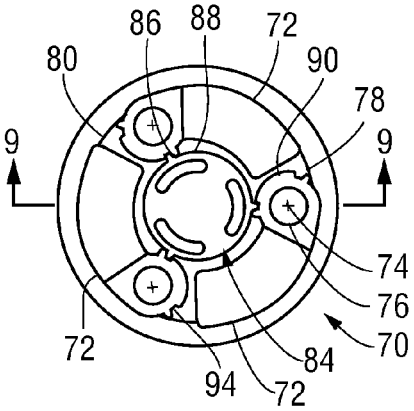
FIG. 7
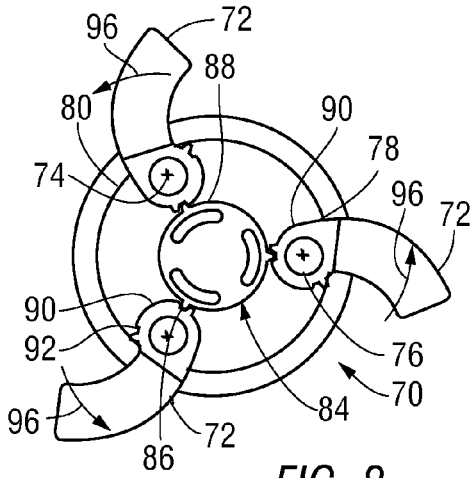
FIG. 8
FIG. 9
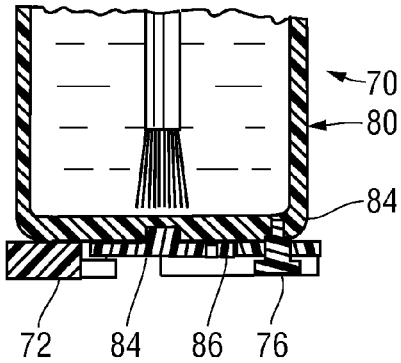

APPLICATION DEVICES FOR COSMETICS

RELATED APPLICATIONS

Not Applicable

FEDERALLY SPONSORED RESEARCH OR DEVELOPMENT

Not Applicable

BACKGROUND OF THE INVENTION

1. Field of the Invention

This invention relates to applicators for cosmetic products, and, more particularly, to applicators for nail polish.

2. Summary of the Background Information

A conventional nail polish bottle includes a glass reservoir with an externally threaded opening, a screw cap removably sealing the opening, and an applicator brush fastened to the screw cap to extend downward into the liquid contents of the reservoir. The glass reservoir holds enough nail polish for 20-25 applications. Nail polish bottles of this type are used both by consumers who paint their own nails, or those of friends, and by operators in beauty salons to paint the nails of clients.

One current trend is an increase in the variety of color patterns formed by the application of nail polish, with multiple colors being applied to individual nails to form, for example, white "tips" extending along the outer edges of the nails while one or more different colors covers the remaining portions of the nails. Multiple colors for painting nails may be chosen for complimenting one another or for representing an institution, such as a school, or the flag of a nation or state. In many cases a particular color pattern is worn for a short time, such as a few hours, instead of for days or weeks, resulting in a need for the availability of small amounts of many colors rather than a large amount of a single color for retouching or reapplication.

Another current trend in the cosmetics and health fields is the use of disposable or "one-time use" tools and supplies to avoid spreading various types of contamination from one person to another. This trend also results in a need for efficient packages holding just enough nail polish for use on a single client.

The patent literature includes a number of descriptions of devices for dispensing a single-use portion of a liquid to be used for cosmetic purposes. For example, a pen is described as dispensing nail polish for a single-use application from a disposable cartridge, which includes a capsule holding the nail polish and a brush to which nail polish is fed from the capsule. The other end of the capsule is sealed with a piston. The pen includes a rod driven against the piston and into the capsule by a ratchet mechanism, with an end of the capsule near the brush first being punctured by a spike allowing the nail polish to flow into the brush through an opening within the spike. Each time the spike is advanced by the ratchet mechanism, more nail polish is pushed into the brush. After completing the application of nail polish, the cartridge is removed and disposed, making the pen ready for the installation of a new cartridge.

Another example of the patent literature describes a disposable container for the application of paints, medicaments and coatings having a compressible hollow body with a closed end and a membrane sealed open end, and a stationary applicator housing fitted on the membrane sealed open end so that when the hollow body containing liquid is compressed, the membrane is punctured or fractured and the liquid is supplied to the applicator.

A dispenser for dispensing a flowable material, which has a container having a side wall and further having a closed end and an open end, is additionally described. A membrane defines a chamber within the container between the membrane and the closed end of the container. The membrane has a weld seam rupturable upon the application of a force to a side wall of the container proximate the membrane. A swab assembly is operably connected to the open end of the container such that the swab assembly is in flow communication with the open end.

A container or case for cosmetics or other products that are applied by an applicator tool, is further described, with the container or case comprising a housing adapted to receive an exchangeable cartridge and a handle adapted to receive an exchangeable applicator tool. In some embodiments, the housing comprises a window for viewing the substance contained in the exchangeable cartridge.

A single-use cosmetic package having a pouch with a front wall and a back wall, with a wand stored in the pouch is also described. Upper and lower seals hermetically seal the perimeter of the pouch. A middle seal divides the pouch into a product reservoir in a lower half of the pouch and a dry chamber in the upper half. The wand projects from a handle end in the dry chamber through the middle seal to an applicator end in the product reservoir. A dog-bone shaped sealing structure on the wand forms a hermetic seal with the middle seal. The dry chamber is opened by pulling opposite tabs to peel the front wall from the back wall. When the wand is pulled from the pouch, a flange on the wand expands the middle seal to form a wiper opening in the product reservoir. The wiper opening is sized to wipe the applicator end of the wand, or an applicator attached to the end of the wand.

An applicator assembly is further described, with the applicator assembly including a base member, a cap member removably associated with the base member, a container for a substance to be applied; and an applicator member removably associated with the container. The container and applicator member are configured to be received within an interior space defined between the base member and cap member.

One problem with the conventional nail polish bottle results from the relatively small size of the screw cap, which must be used as a handle to maneuver the applicator brush during the application of nail polish. The small cap must be grasped between the fingertips of the user, allowing the cap to slip between the fingertips and making it difficult to apply a an accurate pattern of paint to a fingernail. A solution for this problem is described in the patent art in the form of an overshell of compressible material surrounding the applicator cap, with the overshell providing a finger gripping surface on the applicator cap.

SUMMARY OF THE INVENTION

In accordance with a first aspect of the invention, apparatus for applying nail polish is provided, with the apparatus including a reservoir having an opening, a brush, and a cap. The reservoir holds a quantity of nail polish sufficient for a single application to all nails of an average adult woman but insufficient for two applications to all nails of the average adult woman. The cap is removably attached to the reservoir to seal the opening within the reservoir. In this way a quantity of nail polish suitable for a single application to a person is provided within its own applicator.

In accordance with another aspect of the invention, apparatus for applying a liquid is provided with deployable legs, allowing the apparatus to rest in a stable condition on a table surface. The apparatus includes a reservoir, a brush, a cap, and a plurality of legs. The reservoir, which holds the liquid, includes an upper end, having an opening, and a lower end. The cap, which is connected to the brush by a shaft, seals the opening and holds the brush within the liquid when it is connected to the upper end of the reservoir. Each of the legs is movable between a closed position, in which the leg is held inward, adjacent the reservoir, and an open position, in which the leg is held outward, away from the reservoir, by a detent.

In a first version of such an apparatus, a ring is attached to the reservoir adjacent the lower end to pivot about an axis, with each of the legs being attached to pivot about and individual vertical axis on the ring, and with each of the legs being additionally operatively connected to the reservoir to pivot outward from the reservoir when the ring is pivoted about the first axis. For example, the apparatus may additionally include a central gear attached to the reservoir, while each of the legs includes a gear sector engaging the central gear to pivot the legs outward as the ring is turned relative to the reservoir. The detent then holds the ring in a position holding each of the legs to extend outward.

In a second version of such an apparatus, a plurality of pivot pins and a plurality of detents extends around the lower end of the reservoir, with each of the legs being attached to the reservoir by one of the pivot pills to be pivoted from the closed position to the open position, in which the leg is locked by the detent. For example, each of the pivot pins is disposed horizontally, with each of the legs extending upward, with a tip of the leg being disposed between a lip of the cap and the reservoir with the leg in the closed position before the cap is removed.

In accordance with yet another aspect of the invention, apparatus for applying at least one liquid is provided, with the apparatus including a first reservoir, a first brush, a first cap, a handle, and a first piston. The first reservoir, which holds a first liquid, has an external end with an application hole extending through the external end, and an internal end plate, opposite the external end. The first brush is attached to the first reservoir adjacent the application hole to extend outward from the first reservoir. The first cap, which is removably attachable to the external end of the first reservoir to extend around the first brush, includes a pin disposed within the application hole of the first reservoir to seal the application hole of the first reservoir when the first cap is attached to the external end of the first reservoir. The handle is attached to the first reservoir to extend along a first axis and to rotate about the first axis, which extends away from the first reservoir at the internal end plate of the first reservoir. The first piston is disposed within the first reservoir between the internal end plate of the first reservoir and the first liquid held within the first reservoir. The first piston is operatively connected to the handle to move the piston along the first reservoir toward the external end of the first reservoir as the first reservoir is rotated in a preferred direction relative to the handle, causing the first liquid to be pushed outward from the first reservoir through the application hole within the first reservoir with the first cap removed from the external end of the first reservoir. The first piston is sealed against the internal surfaces of the first reservoir to prevent leakage of the first liquid into a space formed between the piston and the internal end plate of the first reservoir. Preferably, the first reservoir additionally includes a shaft hole extending through the internal end plate, while the first piston includes a shaft extending through the shaft hole and a first screw extending within the handle to engage a first plate within the handle. The shaft hole and the shaft are each non-circular to prevent rotation of the shaft within the shaft hole within the first reservoir while allowing the shaft to slide within the shaft hole within the first reservoir. The handle may additionally include interlocking structures providing for the removable attachment of a second handle. The apparatus may additionally then include an attachment member having a body with similar interlocking structure and an attachment ring for attachment to a key ring.

This apparatus may additionally include a second reservoir, similar to the first reservoir, with the first and second reservoirs extending from opposite ends of the handle. The second reservoir holds a second liquid for application. For example, if the first liquid is a nail polish, the second liquid may be a nail polish having a color visibly contrasting with a color of the first liquid, or a nail polish remover. The handle may include a first handle portion, attached to the first reservoir, and a second handle portion, attached to the second reservoir and removably attached to the first handle portion.

Alternately, the apparatus may include a second reservoir with an application hole at an external end. The reservoir holds a first porous material that in turn holds nail polish, and a second porous material, extending outward, through application hole to a tip to which the nail polish is transferred.

In accordance with still another aspect of the invention, apparatus for applying nail polish is provided, with the apparatus including a handle and two reservoirs. Each of the reservoirs includes an application hole and a cap, which is removably attached to cover the application hole. The reservoirs extend outward in opposite directions from the handle to the application hole at the external end of each reservoir, and wherein nail polish flows outward through each of the application holes with the cap covering the application hole removed. The handle may include two handle portions, removably attached to one another, with each of the handle portions being attached to one of the reservoirs.

BRIEF DESCRIPTION OF THE FIGURES

These and other aspects of the invention will be made apparent by reading the following specification in conjunction with the accompanying drawings, in which:

FIG. 5 is a cross-sectional bottom plan view of the applicator of FIG. 1 with the legs closed, shown as indicated by section line 5-5 in FIG. 2;

FIG. 6 is a fragmentary cross-sectional bottom plan view of the applicator of FIG. 1 with the legs closed, shown as indicated by section line 6-6 in FIG. 2;

FIG. 7 is a bottom plan view of an applicator made in accordance with a second embodiment of the invention, shown with legs therein closed;

FIG. 8 is a bottom plan view of the applicator of FIG. 7 with the legs open;

FIG. 9 is a fragmentary cross-sectional elevation of the applicator of FIG. 7, taken as indicated by section line 9-9 therein;

DETAILED DESCRIPTION OF THE INVENTION

Figure 1:
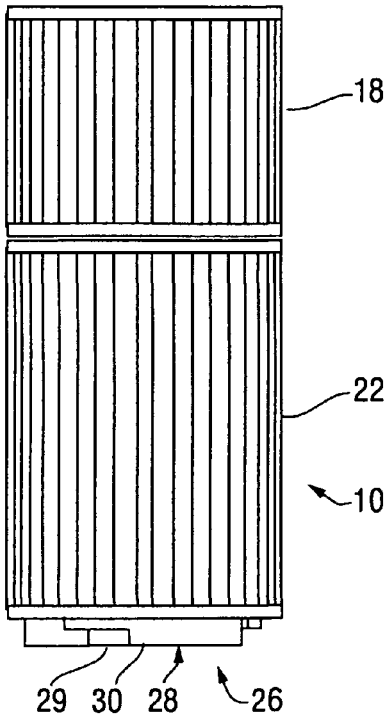
FIG. 1 is an elevation of an applicator made in accordance with a first embodiment of the invention, shown with legs therein closed.
Figure 2:
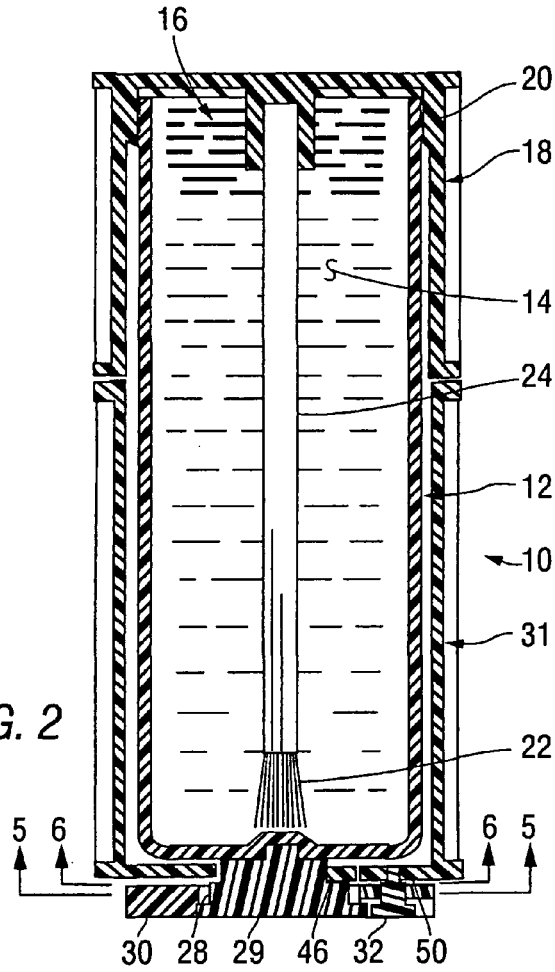
FIG. 2 is a cross-sectional elevation of the applicator of FIG. 1 with the legs closed.

FIGS. 1 and 2 show an applicator 10, for applying a liquid such as nail polish, built in accordance with a first embodiment of the invention, with FIG. 1 being an elevation thereof while FIG. 2 is a cross-sectional elevation thereof. The applicator 10 includes a reservoir 12, holding the liquid 14, with the reservoir 12 having an opening 16 sealed by a cap 18, removably attached to the reservoir 12 by a conventional threaded connection 20. A brush 22 for application of the liquid 14 is attached to the cap 18 by a shaft 24, which holds brush 22 within the liquid 14 while the cap 18 is attached to the reservoir 12 as shown in the figures.

Preferably, the applicator 10 is configured for a single application of nail polish to the nails of a person's hands and feet, allowing the person to easily carry the applicator 10, or alternatively allowing the applicator 10 to be used in a salon without causing a customer to worry about contamination that may result from using the same nail polish applicator on multiple customers. For example, the reservoir 12 is filled with a quantity of the liquid 14 that is sufficient for a single application to all the nails of an average adult woman but insufficient for two such applications. However a reservoir holding such a small quantity of the liquid 14 can be quite small, so that an advantage is achieved in transporting and storing enough of the applicators 10 for a number of applications of nail polish, while making it difficult to use the applicator 10 in the conventional way, with the reservoir 12 resting on a horizontal surface, such as a table, while the brush 22 is used to apply the liquid 14 as the cap 18 is used as a handle. In particular, the small size of the base 26 of the applicator 10 can make it too easy to tip the applicator 10 over when the brush 22 is returned to the reservoir 12 to pick up more of the liquid 14. In accordance with the invention, this difficulty is overcome by providing a plurality of legs 28 that are outwardly deployable to increase the effective size of the base 26.

Figure 3:
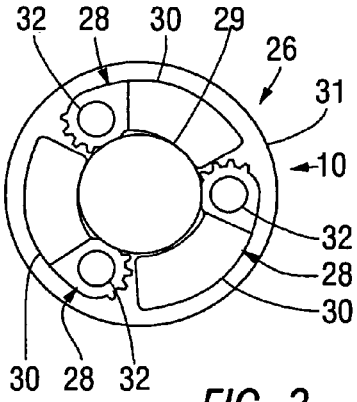
FIG. 3 is a bottom plan view of the applicator of FIG. 1 with the legs closed.
Figure 4:
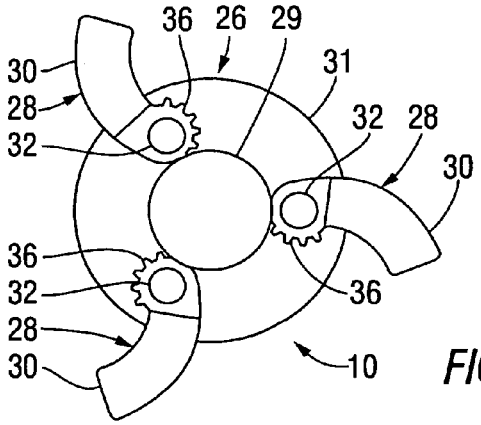
FIG. 4 is a bottom plan view of the applicator of FIG. 1 with the legs open.

FIGS. 3 and 4 are bottom plan views of the applicator 10, together showing the outward deployment of the legs 28, with FIG. 3 showing the legs 28 in a closed position, as the applicator 10 is shipped and stored, and with FIG. 4 showing the legs 28 in an open position, with the applicator 10 ready for use with placement on a horizontal surface. When the applicator 10 is placed atop a horizontal surface (not shown), contact with the surface occurs with a central pad 29 attached to the reservoir 12 and with outer pads 30 forming portions of each of the legs 28.

FIG. 5 is a cross-sectional bottom plan view of the applicator 10, taken as indicated by section line 5-5 in FIG. 2 to show a mechanism used to move the legs 28 from the closed position of FIG. 3, to the open position of FIG. 4. Each of the legs 28 is pivotally attached to a ring 31 by a pivot pin 32. The ring 31 is itself attached to the reservoir 12 to pivot about a central vertical axis 34. Each of the legs 28 includes a gear segment 36, which is coaxial with the pivot pin 32 attaching the leg 28 to the ring 31, while a central gear 38 is attached to the reservoir 12 in alignment with the central vertical axis 34. When the ring 20 is pivoted in the direction of arrow 40 relative to the reservoir 12, the engagement between the gear segments 36 and the central gear 28 causes the legs 28 to each rotate outward, in the direction of arrow 42, moving from the closed position of FIG. 3 to the open position of FIG. 4.

FIG. 6 is a fragmentary cross-sectional bottom plan view of the applicator 10, taken as indicated by section line 6-6 in FIG. 2 show a detent 44 used to hold the ring 31 in a position holding the legs 28 in the open position of FIG. 3. The detent 44 includes a tooth 46 flexibly attached by a beam 48 to a web 50, which extends below the reservoir 12 as a part of the ring 31. The detent 44 additionally includes a surface 52 extending along an attachment plug 54, which is attached to the reservoir, for example, by adhesive attachment or by ultrasonic welding. As the ring 31 is pivoted in the direction of arrow 41 into a position holding the legs 28 open, as shown in FIG. 4, the tooth 46 is moved into a groove 54 within the surface 52, to be held within the groove 54. Optionally, a second groove 56 may be provided to hold the ring 31 in a position holding the legs 28 closed. (As the term is used herein "detent" means a mechanism holding a member in a predetermined position which may be overcome by the application of a force."). Referring additionally to FIG. 2, the web 50 is also seen as extending into an annular space between the central gear 28, which is formed as a portion of the attachment plug 54, and the reservoir 12, restraining movement of the ring 31 to pivoting relative to the reservoir 12.

Referring again to FIGS. 1 and 2, the ring 31 includes a ring cylindrical portion 56, extending upward around the reservoir 12, while the cap 18 includes a cap cylindrical portion 58, extending downward around the reservoir 12, nearly to the ring cylindrical portion 56. A preferred process for using the applicator 10 begins with holding both the cylindrical portions 56, 58 while turning the ring cylindrical portion in the direction of arrow 40 (shown in FIG. 4) relative to the cap cylindrical portion 58, first to move the legs 28 into the open position of FIG. 4, and then to loosen and remove the cap 18 from the reservoir. If the cap 18 loosens and is removed before the legs 28 are moved into the open position, the legs 28 can then still be moved into the open position by turning the ring 31 in the direction of arrow 40 relative to the reservoir 12, which has been exposed by removing the cap 18. In either case, the opened reservoir 12 is then placed on a horizontal surface to be supported by the opened legs 28, while nails are painted in the conventional manner, using the brush 22 while holding the cap 18.

An applicator 70, made in accordance with a second embodiment of the invention will now be discussed, with reference being made to FIGS. 7-9. FIGS. 7 and 8 are each bottom plan views of the applicator 70, with FIG. 7 showing three legs 72 therein in a closed position while FIG. 8 shows the legs 72 in an open position. FIG. 9 is a fragmentary elevation of the applicator 70, taken as indicated by section line 9-9 in FIG. 7. Within the applicator 70, each of the legs 72 is attached to pivot about a vertical axis 74 by a pivot pin 76 attached at a lower end 78 of a reservoir 80 holding a liquid 82 to be applied. A detent plate 84 is rigidly attached to the reservoir 80, holding a tooth 86 on a flexible member 88 in contact with a detent surface 90 on each of the legs 72. Each of the detent surfaces 90 includes a first groove 92 holding the leg 72 in the closed position of FIG. 7 and a second groove 94 holding the leg 72 in the open position of FIG. 8. Before the applicator 70 is used to apply the liquid 84, each of the legs 72 is pivoted outward in the direction of an associated arrow 96. Other aspects of the applicator 70 are as described above regarding the applicator 10.

Figure 10:
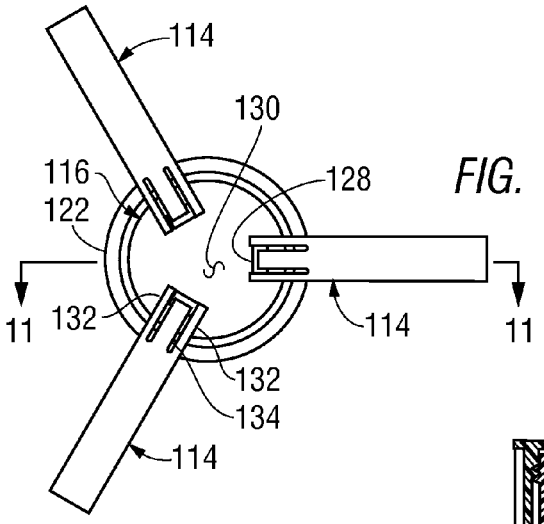
FIG. 10 is a bottom plan view of an applicator made in accordance with a third embodiment of the invention.
Figure 11:
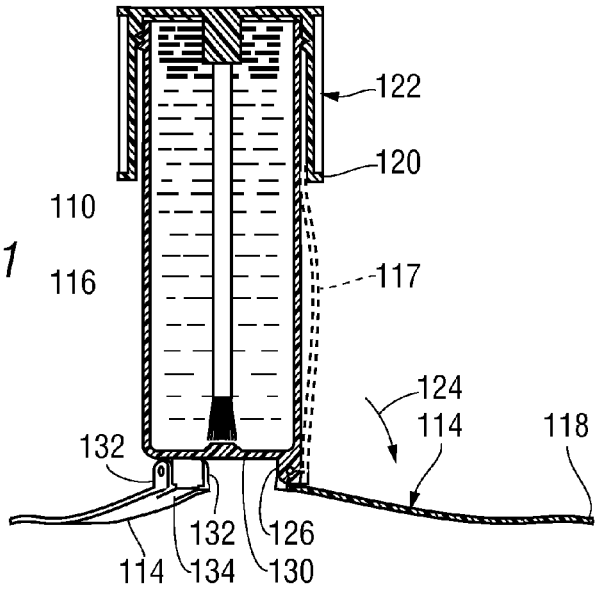
FIG. 11 is a cross-sectional elevation of the applicator of FIG. 10, taken as indicated by section lines 11-11 therein.
Figure 12:
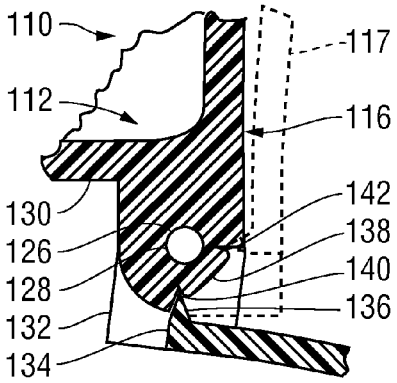
FIG. 12 is a fragmentary cross-sectional elevation of the applicator of FIG. 10, also taken as indicated by section lines 11-11 therein, showing a detent structure.

An applicator 110, made in accordance with a third embodiment of the invention, will now be discussed, with reference being made to FIGS. 10-12. FIG. 10 is a bottom plan view of the applicator 110, while FIG. 11 is a cross-sectional elevation of the applicator 110, taken as indicated by section-line 11-11 in FIG. 10. FIG. 12 is a fragmentary cross-sectional elevation of the applicator 110, also taken as indicated by section line 11-11 in FIG. 10, showing a pivoting and detent arrangement 112 attaching each of three legs 114 to a reservoir 116. In each of these figures, the legs 114 are shown as opened. In FIGS. 11 and 12, one of the legs 114 is additionally shown by dashed lines 117 in a closed position, extending upward along the reservoir, with a tip portion 118 of the leg 114 held between a downward-extending lip 120 of a cap 122 and the reservoir 116. In this way, the cap 122 must be removed before the legs 114 are opened, simplifying the bulk storage of applicators 110 before use. Thus, after the cap 122 is removed, but before the applicator 110 is placed on a horizontal surface, each of the legs 114 is opened by pivoting in the direction of arrow 124 about a horizontal pin 126. A pivot block 128 is formed as a part of the reservoir 116 to pivotally mount each of the legs 114 and to provide detent surfaces holding the legs 114 in open and closed positions, with the pivot blocks 128 being arranged to extend around a lower portion 130 of the reservoir 116. Each of the legs 114 includes a pivoting portion 132, engaging the pin 126 at each side of a central detent portion 134, which provides a tooth 136 engaging a detent surface 138 extending along the pivot block 128. The detent surface 138 includes a first groove 140 holding the leg 114 open and a second groove 142 holding the leg 114 closed.

Each of the applicators 10, 70, and 110 is preferably filled and used as a single application device. For example, each of the applicators 10, 70, and 110 is preferably filled with nail polish sufficient for a single application to all nails of an average adult woman but insufficient for two applications to all nails of the average adult woman. Each of the applicators 19, 70, and 110, despite its small size, can be used in a conventional manner on a horizontal surface because it includes a number of attached legs that can be moved into an open position, providing a large enough base to prevent tipping the reservoir therein over while applying nail polish to a brush.

Figure 13:
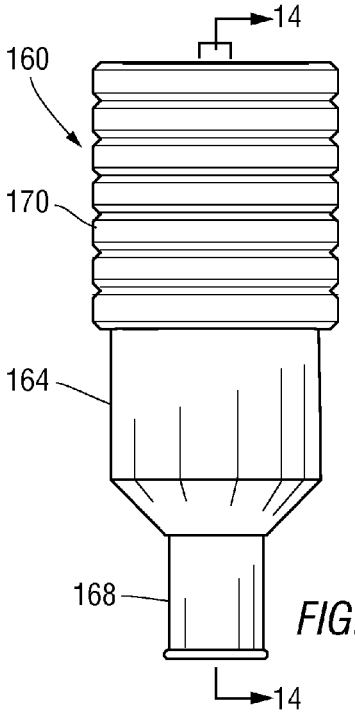
FIG. 13 is an elevation of an applicator made in accordance with a fourth embodiment of the invention.
Figure 14:
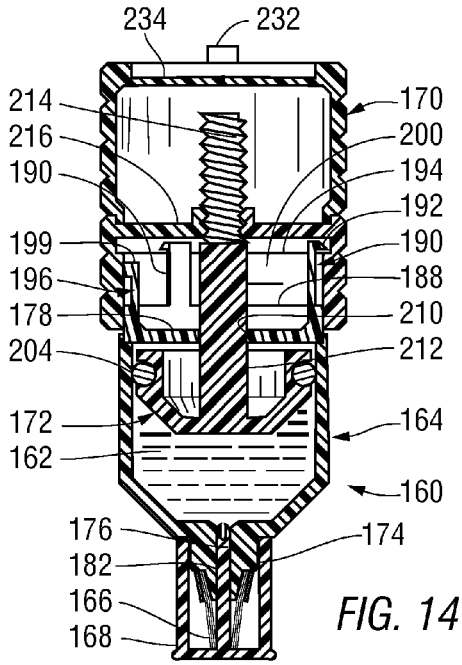
FIG. 14 is a cross-sectional elevation of the applicator of FIG. 13; taken as indicated by section line 14-14 therein, showing the applicator full of a liquid.
Figure 15:
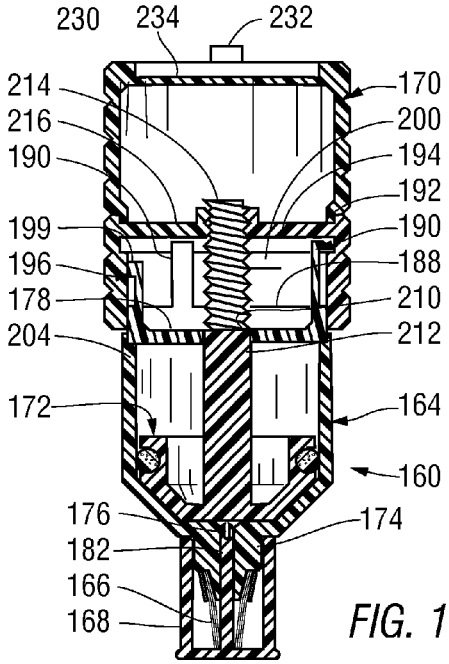
FIG. 15 is a cross-sectional elevation of the applicator of FIG. 13; taken as indicated by section line 14-14 therein, showing the applicator empty.
Figure 16:
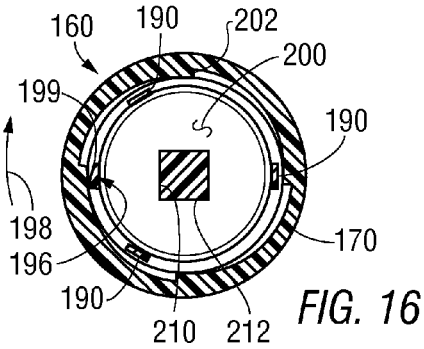
FIG. 16 is a cross-sectional plan view of the applicator of FIG. 13, taken as indicated by section line 16-16 in FIG. 14.
Figure 17:
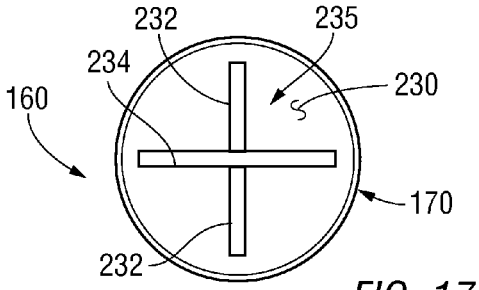
FIG. 17 is a plan view of the applicator of FIG. 13.

An applicator 160, built in accordance with a fourth embodiment of the invention for use as a handheld pen will now be discussed, with reference being made to FIGS. 13-17. FIG. 13 is an elevation of the applicator 160. FIGS. 14 and 15 are cross-sectional elevations of the applicator 160, taken as indicated by section line 14-14 in FIG. 13, with FIG. 14 showing the applicator 160 filled with a liquid 162 while FIG. 15 shows the applicator 160 as empty. FIG. 16 is a cross-sectional plan view, taken as indicated by section line 16-16 in FIG. 14, while FIG. 17 is a plan view of the applicator 160.

The applicator 160 includes a reservoir 164, a brush 166, a cap 168, a handle 170, and a piston 172. The reservoir 164, which holds the liquid 162, has an external end 174, through which an application hole 176 extends, and an internal end plate 178, opposite the external end 174. The brush 166 is attached to the reservoir 164 adjacent the application hole 176 to extend outward, in the direction of arrow 180, from the reservoir 164. The cap 168, which is removably attachable to the external end 174 of the reservoir 164 to extend around the brush 166, includes a pin 182 disposed within the application hole 176 of the reservoir 164 to seal the application hole 176 when the cap 168 is attached to the external end 174.

The handle 170 is attached to the reservoir 164 to extend away from the reservoir 164 at the internal end plate 178 of the reservoir 164. Specifically, the handle 170 is constrained to rotate about an axis of rotation 184 with a cylindrical hole 186 of the handle 170 being held to extend around a peripheral rib 188 of the reservoir 164 by three latches 190, each of which includes a tooth 192, flexibly mounted on the external cylindrical end 188 to engage an internal ledge 194 of the handle 170. This arrangement allows the reservoir 164 to be snapped into place within the handle 170 during the assembly of the applicator 170 in a manner then holding the reservoir 164 and the handle 170 together while allowing relative rotation.

Preferably, a ratchet mechanism 196 is additionally provided to produce a clicking noise as the handle 170 is rotated in the preferred direction of arrow 198 relative to the reservoir 164. For example, the ratchet mechanism 196 includes a ratchet tooth 198, flexibly mounted on the peripheral rib 188 of the reservoir to engage a ratchet track 200 extending as an internal surface around the to produce an audible click whenever a step 202 on the ratchet track 202 is moved past the ratchet tooth 198, with the handle 170 being rotated in the preferred direction of arrow 198 relative to the reservoir 164.

The piston 172 is disposed within the reservoir 162 between the internal end plate 178 of the reservoir 164 and the liquid 162 held therein. The piston 172 is operatively connected to the handle 170 to move the piston 172 along the reservoir 172 in the direction of arrow 180 toward the external end 174 of the reservoir 164 as the handle 170 is rotated in the preferred direction of arrow 198 relative to the reservoir 164, causing the liquid 162 to be pushed outward, in the direction of arrow 180, from the reservoir 164 through the application hole 176 with the cap 168 removed from the external end 174 of the reservoir 164. The piston 172 is sealed, for example by an elastomeric O-ring 204 against an internal surface 206 of the reservoir to prevent leakage of the liquid into a space 208 formed between the piston 172 and the internal end plate 178 of the reservoir 164. Preferably, the reservoir 164 additionally includes a shaft hole 210 extending through the internal end plate 178, while the piston 172 includes a shaft 212 extending through the shaft hole 210 and a screw 214 extending within the handle 170 to engage a threaded plate 216 within the handle 170. The shaft hole 210 and the shaft 212 are each non-circular to prevent rotation of the shaft 212 within the shaft hole 210 while allowing the shaft 212 to slide within the shaft hole 210.

Figure 18:
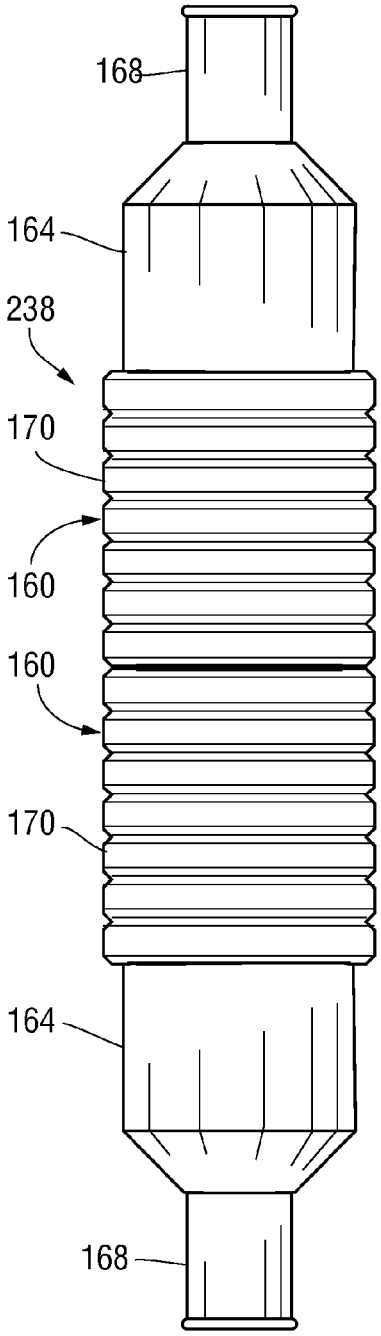
FIG. 18 is an elevation of a double applicator formed by joining two of the applicators of FIG. 13.

The handle 170 may additionally include interlocking structures providing for the removable attachment of a second handle 170. For example, the end surface 230 of the handle 170 includes a pair of ribs 232 and a slot 234 arranged in a cruciform pattern 235, configured so that ribs 232 of each of two handles 170 fit tightly into the slot of the other handle 170, forming a double applicator 236, which is formed by attaching two applicators 160 by their handles 170, as shown in the elevation of FIG. 18, with the two reservoirs 164 within the applicators 160 extending away from one another. In this way a handle 238 is formed from the two handles 170, so that nail polish can be applied from either reservoir 164 by turning that reservoir 164 while the handle 238 is held still. For example, the two reservoirs 164 may be filled with nail polish having visually contrasting colors, so that the double applicator 236 can be used to form two-tone patterns.

Figure 19:
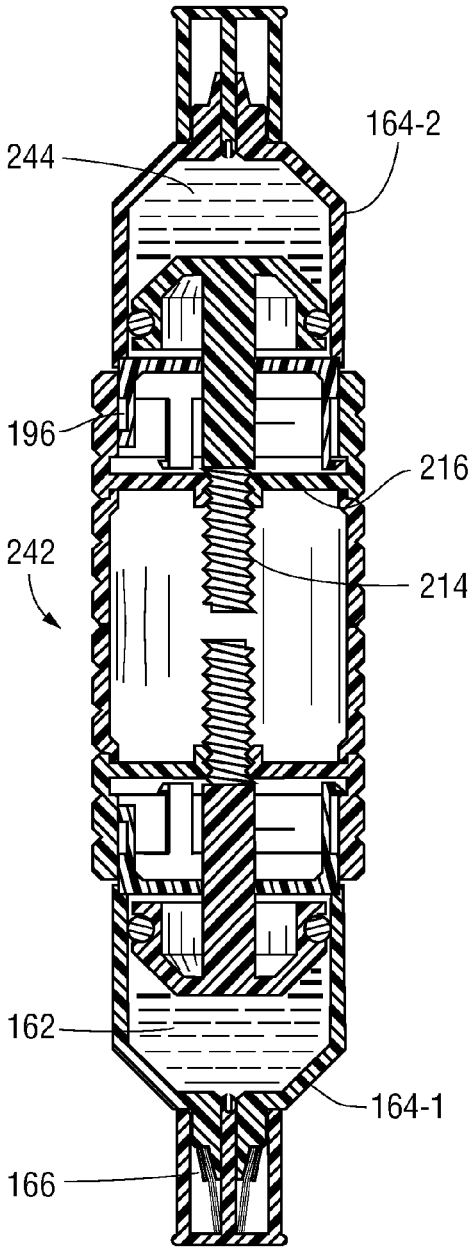
FIG. 19 is a cross-sectional elevation of a double applicator formed in accordance with a fifth embodiment of the invention to have a single, inseparable handle.

FIG. 19 is an example of a double applicator 240 formed in accordance with a fifth embodiment of the invention to include a single inseparable handle 242 disposed between two reservoirs 164, with similar parts in different embodiments being accorded like reference numbers. In the example of FIG. 19, a first reservoir 164-1 holds a quantity of nail polish 162, while a second reservoir, 164-2 holds a quantity of a liquid 244, such as a lotion or a nail polish remover, which is not applied with a brush. While the brush 166 is therefore not provided with the second reservoir 164-2, the ratchet mechanism 196 and the screw 214, engaging a threaded plate 216 within the handle 242 are used to provide a flow of the liquid 244 that can be easily and accurately controlled. Alternately, the second reservoir may include a brush 166 to be used for the application of nail polish.

Figure 20:
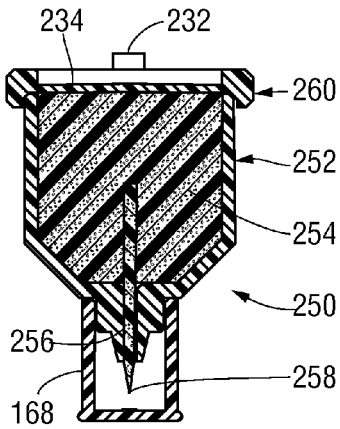
FIG. 20 is a cross-sectional elevation of an applicator built in accordance with the sixth embodiment of the invention.
Figure 21:
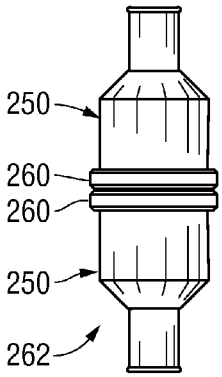
FIG. 21 is an elevation of a double applicator formed by attaching two of the applicators of FIG. 20 together.
Figure 22:
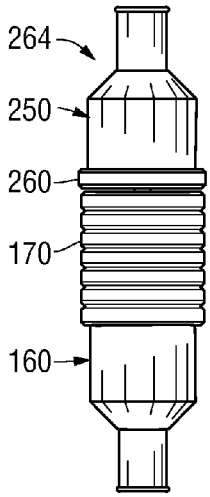
FIG. 22 is an elevation of a double applicator formed by attaching the applicator of FIG. 13 to the applicator of FIG. 20.

FIG. 20 is a cross-sectional elevation of an applicator 250, made in accordance with a sixth embodiment of the invention to include a reservoir 252 with an application hole 254 at an external end. The reservoir 252 holds a first porous material 254 that in turn holds nail polish, and a second porous material 256, extending outward, through application hole to a tip 258 to which the nail polish is transferred for application. The applicator 250 additionally includes a removable cap 168 and a handle 260 with a pair of ribs 232 and a slot 234, arranged as described above regarding FIG. 17, allowing the applicator 250 to be attached to another applicator 250, to form a double applicator 262, as shown in the elevation of FIG. 21, and additionally allowing the applicator 250 to be attached to the applicator 160, described above in reference to FIGS. 13-17, to form a double applicator 264, as shown in the elevation of FIG. 22. Alternatively, the two handles 260 of the double applicator 262 may be combined to form a single, non-separable handle, and the handles 170, 260 of the double applicator 264 may be combined to form a single handle.

Figure 23:
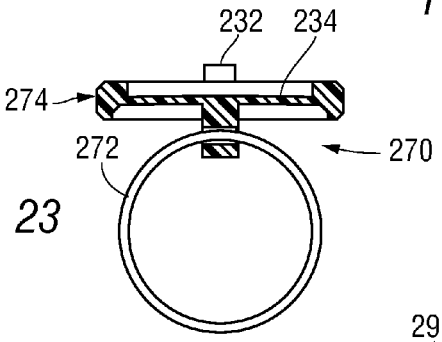
FIG. 23 is a cross-sectional elevation of an attachment device built for attachment to the applicator of FIG. 13 or the applicator of FIG. 20.

FIG. 23 is a cross-sectional elevation of an attachment device 270 that includes an attachment ring 272, for attachment to a key ring, and a handle 274 with a pair of ribs 232 and a slot 234, arranged as described above regarding FIG. 17, allowing the attachment device 270 to be attached to the applicator 160 or to the applicator 250.

Figure 24:
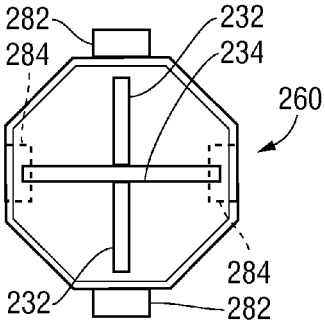
FIG. 24 is a handle configured for alternative use in the applicator of FIG. 20.

FIG. 24 is a plan view of an alternative handle 280 that can be provided in place of the handle 170 in the applicator 160, described above in reference to FIGS. 14-17, and in the applicator 250, described above in reference to FIG. 20. The alternative handle 280 includes a pair of ribs 232 and a slot 234, arranged as described above regarding FIG. 17, allowing the end-to-end attachment of devices as described above, and additionally includes a pair of cylindrical plugs 282 and a pair of cylindrical holes 284, allowing side-by-side attachment of devices.

Figure 25:
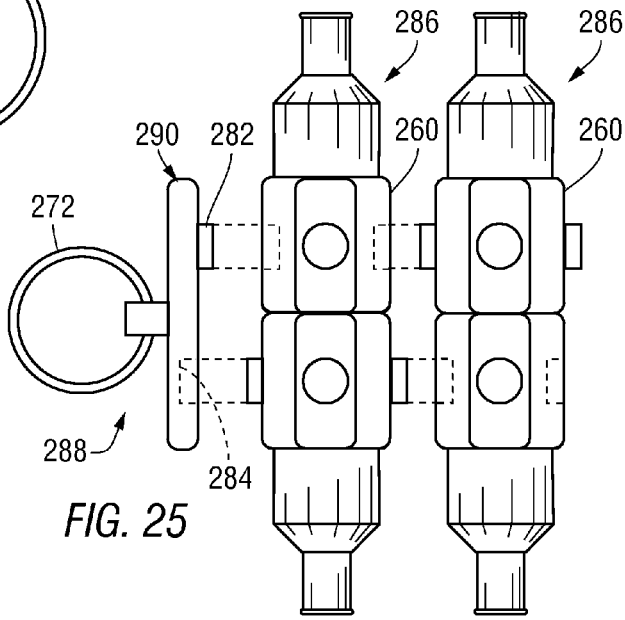
FIG. 25 is an elevation of devices in an exploded relationship with one another, aligned for connection using features of the handle of FIG. 24.

FIG. 25 is an elevation showing a pair of double applicators 286 including the alternative handles 280, shown in an exploded relationship, aligned for attachment to one another and for attachment to an alternative attachment device 288, with an attachment ring 272 and a handle 290, also having a cylindrical plug 282 and a cylindrical hole 284.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. Apparatus for applying nail polish comprising:

a reservoir, having an opening, and including an upper end and a lower end, wherein the reservoir is configured to hold a quantity of nail polish;

a brush;

a cap removably attached to the reservoir to seal the opening within the reservoir, wherein the cap is connected to the brush by a shaft holding the brush within the quantity of nail polish when the cap is attached to the upper end of the reservoir, and a base formed by lowermost surfaces of the apparatus and a plurality of legs, wherein each leg is movable between a closed position in which the leg is held inward, adjacent the reservoir, and an open position, in which the leg is held outward, away from the reservoir, by a detent, and a base, formed by lowermost surfaces within the apparatus to contact a horizontal surface upon which the apparatus is placed, wherein moving each leg into the open position enlarges an effective size of the base.

2. The apparatus of claim 1, wherein the apparatus additionally comprises a ring attached to the reservoir adjacent a lower end of the reservoir to pivot about a first vertical axis, wherein each of the legs is attached to pivot about an individual vertical axis on the ring, each of the legs is additionally operatively connected to the reservoir to pivot outward from the reservoir when the ring is pivoted about the first axis, and the detent holds the ring in a position holding each of the legs to extend outward, away from the reservoir.

3. Apparatus for applying a liquid, comprising:

a reservoir holding the liquid and including an upper end, having an opening, and a lower end;

a brush;

a cap, sealing the opening when the cap is connected to the upper end of the reservoir, wherein the cap is connected to the brush by a shaft holding the brush within the liquid when the cap is attached to the upper end of the reservoir, a plurality of legs, wherein each leg is movable between a closed position in which the leg is held inward, adjacent the reservoir, and an open position, in which the leg is held outward, away from the reservoir, by a detent, and a base, formed by lowermost surfaces within the apparatus to contact a horizontal surface upon which the apparatus is placed, wherein moving each leg into the open position enlarges an effective size of the base.

4. The apparatus of claim 3, additionally comprising a ring attached to the reservoir adjacent the lower end of the reservoir to pivot about a first vertical axis, wherein each of the legs is attached to pivot about an individual vertical axis on the ring, each of the legs is additionally operatively connected to the reservoir to pivot outward from the reservoir when the ring is pivoted about the first axis, and the detent holds the ring in a position holding each of the legs to extend outward, away from the reservoir.

5. The apparatus of claim 4, additionally comprising a central gear attached to the reservoir adjacent the lower end of the reservoir, wherein each of the legs additionally comprises a gear sector, and each of the legs is moved from the closed position to the open position by engagement of the gear sector of the leg with the central gear.

6. Apparatus for applying nail polish comprising a reservoir, having an opening, an upper end, an upper end, and a lower end, holding a quantity of nail polish;

a brush; and a cap, removably attached to the reservoir to seal the opening within the reservoir, and connected to the brush by a shaft holding the brush within the quantity of nail polish when the cap is attached to the upper end of the reservoir;

a plurality of legs, wherein each leg is movable between a closed position, in which the leg is held inward, adjacent the reservoir, and an open position, in which the leg is held outward, away from the reservoir by a detent; and a ring attached to the reservoir adjacent a lower end of the reservoir to pivot about a first vertical axis, wherein each of the legs is attached to pivot about an individual vertical axis on the ring, wherein each of the legs is additionally operatively connected to the reservoir to pivot outward from the reservoir when the ring is pivoted about the first axis, and wherein the detent holds the ring in a position holding each of the legs to extend outward, away from the reservoir.

* * * * *